US006517072B1

(12) United States Patent
McInerney

(10) Patent No.: US 6,517,072 B1
(45) Date of Patent: Feb. 11, 2003

(54) CASINO TABLE CARD GAME

(76) Inventor: Mark McInerney, 5813 Morning Field Pl., St. Louis, MO (US) 63128

( * ) Notice: Subject to any disclaimer, the term of this patent is extended or adjusted under 35 U.S.C. 154(b) by 0 days.

(21) Appl. No.: 09/524,187

(22) Filed: Mar. 13, 2000

Related U.S. Application Data

(60) Provisional application No. 60/124,171, filed on Mar. 15, 1999.

(51) Int. Cl.[7] ..... A63F 3/00

(52) U.S. Cl. ..... 273/236; 273/292; 273/309; 273/274; 463/13

(58) Field of Search ..... 273/236, 292, 273/309, 274; 463/13

(56) References Cited

U.S. PATENT DOCUMENTS

| | | | | | |
|---|---|---|---|---|---|
| 3,667,757 | A | * | 6/1972 | Holmberg | 273/135 G |
| 4,836,553 | A | * | 6/1989 | Suttle et al. | 273/292 |
| 4,861,041 | A | * | 8/1989 | Jones et al. | 273/292 |
| 5,078,405 | A | * | 1/1992 | Jones et al. | 273/309 |
| 5,154,429 | A | * | 10/1992 | LeVasseur | 273/292 |
| 5,248,142 | A | * | 9/1993 | Breeding | 273/138 R |
| 5,288,081 | A | * | 2/1994 | Breeding | 273/292 |
| 5,364,104 | A | * | 11/1994 | Jones et al. | 273/292 |
| 5,364,105 | A | * | 11/1994 | Jones | 273/292 |
| 5,377,973 | A | * | 1/1995 | Jones et al. | 273/85 CP |
| 5,437,462 | A | * | 8/1995 | Breeding | 273/292 |
| 5,544,783 | A | * | 8/1996 | Jones et al. | 273/309 |
| 5,544,892 | A | * | 8/1996 | Breeding | 273/292 |
| 5,794,964 | A | * | 8/1998 | Jones et al. | 273/309 |
| 5,795,225 | A | * | 8/1998 | Jones et al. | 463/13 |
| 5,813,673 | A | * | 9/1998 | Richardson | 272/292 |
| 5,839,732 | A | * | 11/1998 | Guidi | 273/292 |
| 5,863,042 | A | * | 1/1999 | Lo | 273/292 |
| 5,873,572 | A | * | 2/1999 | Huynh | 273/292 |
| 5,913,726 | A | * | 6/1999 | Jones et al. | 463/13 |
| 5,928,081 | A | * | 7/1999 | Bochichio et al. | 463/13 |
| 5,944,316 | A | * | 8/1999 | Hernandez | 273/292 |
| 5,947,821 | A | * | 9/1999 | Stone | 463/13 |
| 5,951,011 | A | * | 9/1999 | Potter et al. | 273/292 |
| 5,951,012 | A | * | 9/1999 | Feola | 273/292 |
| 5,964,464 | A | * | 10/1999 | Jones | 273/292 |
| 6,007,066 | A | * | 12/1999 | Moody | 273/292 |
| 6,019,374 | A | * | 2/2000 | Breeding | 273/292 |
| 6,045,130 | A | * | 4/2000 | Jones et al. | 273/292 |
| 6,102,402 | A | * | 8/2000 | Scott et al. | 273/292 |
| 6,126,167 | A | * | 10/2000 | Kowalczyk | 273/303 |
| 6,131,907 | A | * | 10/2000 | Nucufora et al. | 273/292 |
| 6,220,597 | B1 | * | 4/2001 | Scibetta | 273/292 |
| 6,234,895 | B1 | * | 5/2001 | Jones et al. | 463/13 |
| 6,270,405 | B1 | * | 8/2001 | Ferguson | 463/13 |
| 6,273,424 | B1 | * | 8/2001 | Breeding | 273/292 |
| 6,276,689 | B1 | * | 8/2001 | Brown | 273/292 |

* cited by examiner

*Primary Examiner*—Benjamin H. Layno
*Assistant Examiner*—Dolores R. Collins
(74) *Attorney, Agent, or Firm*—Paul M. Denk

(57) ABSTRACT

A playing card, wagering game method where each player antes one unit. The dealer will deal four cards down to each player and four cards down to himself. Each player evaluates their hand and elects to either fold or challenge the remaining players and dealer. Any player who folds, surrenders his ante to the house. The total amount of antes remaining after each player evaluates his hand will be referred to as the "ante pot". All players electing to remain, or challenge, (including the dealer), must wager an amount equal to the ante pot. The dealer always challenges the pot. After each player has elected to either fold or challenge, the dealer, after "burning" a card, will deal or "flop" another three community cards to be used by all challenging participants. The highest poker hand of each participant using their initial four cards plus the three community cards wins the pot. The first player to act is determined on a rotating basis to eliminate position advantage. Single player versus the dealer has the option to double the "ante pot," resulting in the dealer likewise adding to the ante pot.

10 Claims, 2 Drawing Sheets

CASINO TABLE CARD GAME

CROSS-REFERENCE TO RELATED APPLICATION

This application is a non-provisional patent application based upon provisional patent application having Ser. No. 60/124,171, filed on Mar. 15, 1999, which is owned by the same inventor.

BACKGROUND OF THE INVENTION

The present invention relates to playing card wagering games that can be played with a standard deck of cards or by video machine technology in a casino or home environment. In particular, it relates to a method and apparatus for playing a wagering game, wherein the game is a variation Hybrid of Texas Hold Em and Omaha Poker and provides players the opportunity to compete against each other as well as the House. The manner of wagering is unique in that it requires the players who elect to challenge along with the dealer to match the ante pot.

DESCRIPTION OF THE PRIOR ART

There are many wagering games used for gambling. Such games should be exciting to arouse player's interest and uncomplicated so they can be understood easily by a large number of players. Ideally, the games should include more than one wagering opportunity during the course of the game, yet be able to be played rapidly to a wager resolving outcome. Exciting play, the opportunity to make more than one wager and rapid wager resolution enhance players' interest and enjoyment because the frequency of betting opportunities and bet resolution is increased.

Wagering games, particularly those intended primarily for play in casinos, should provide players with a sense of participation and control, the opportunity to make decisions, and reasonable odds of winning, even though the odds favor the casino, house, dealer or banker. The game must also meet the requirements of regulatory agencies.

Wagering games, including wagering games for casino play, with multiple wagering opportunities are known. U.S. Pat. Nos. 4,861,041, and 5,0987,405 (both to Jones, et al.) disclose methods and apparatus for progressive jackpot gaming, respectively. The former patent discloses that a player may make an additional wager at the beginning of a hand, the outcome of the additional wager being determined by a predetermined arrangement of cards in the player's hand. U.S. Pat. No. 4,836,553 (to Suttle and Jones) discloses a modified version of a five card stud poker game.

Additional symbols may be added to the usual means of playing a game to increase wagering opportunities. This is disclosed in U.S. Pat. No. 5,098,107 (to Boylan et al). Somewhat similarly, U.S. Pat. No. 3,667,757 (to Holmberg) discloses a board game and apparatus, including a way to allow the player to make a choice with respect to several different alternative types of game play and risk bearing strategies. The alternative play is based on providing cards with additional symbols and therefore, a new set of odds. The game and apparatus disclosed by Holmberg requires new sets of rules, relatively complicated procedures and time for a player to learn the game.

U.S. Pat. No. 5,154,429 (to LeVasseur) involves the dealer playing multiple hands against a player's single hand, whereby the number of hands played in the same amount of time is increased.

The desired attributes of wagering games outlined above are in large measure provided by the method and apparatus for a wagering game in accordance with the present invention. The game is uncomplicated, exciting and provides the opportunity for players to make multiple wagers and choices regarding those wagers.

SUMMARY OF THE INVENTION

The wagering game of the present invention is played with a single, typical fifty-two card poker deck and broadly involves the generally well recognized and accepted set of rules, procedures and wager-resolving outcomes of Hybrid of Texas Hold Em and Omaha Poker. The game method comprises each player placing an ante of one unit to participate in the game. Cards are dealt by a dealer, four down to each player, as well as four down to the dealer. Players evaluate their hand and elect to either fold or challenge the remaining players and dealer. Any player who folds, surrenders his ante to the house. The total amount of antes remaining after each player evaluates his hand will be referred to as the "ante pot". All players electing to remain, or challenge, including the dealer who must always challenge regardless of the strength of his hand, must wager an amount equal to the ante pot. After each player has elected to either fold or challenge, the dealer will, after "burning" a card, deal of "flop" another three community cards to be used by all challenging participants. The highest poker hand of each participant using their initial four cards plus the three community cads wins the pot. The first player to act is determined on a rotating basis to eliminate position advantage. This is done by the dealer placing a "button" or marker to indicate which player shall initiate action. The cards are then reshuffled for the next hand.

Apparatus is disclosed for playing the wagering game according to the method outlined above. A typical gaming table, with a playing surface, is modified to include specific areas that provide locations for placing the wagers and for displaying the common cards. A display device may be associated with the apparatus for displaying game information.

Single player versus the dealer has the option to double the "ante pot," resulting in the dealer doing likewise.

It is an object of the present invention to provide an exciting and interesting wagering game. Another object of the present invention is to provide a wagering game that is easy to learn, largely being based on Texas Hold Em and Omaha Poker and the well known ranking of poker hands.

It is another object of the present invention to provide a new variation of well known wagering games, Texas Hold 'Em and Omaha Poker, which is made interesting by providing the opportunity for players to compete against each other as well as the house by making multiple wagers based upon the strength of their hands.

Still another object of the present invention is to provide a wagering game that is easy to learn, yet demands skill of players in making strategic decisions about whether to fold or challenge the competing players and dealer.

It is yet another object of the present invention to provide a unique, exciting card game for play in casinos or at home and on various media including casino tables, video poker machines, video lottery terminals or home computers.

It is an advantage of the game of the present invention that wagering decisions are inherent in the game. The game enhances players'sense of participation and takes advantage of players' knowledge that the house does not take a "rake' or percentage from the final pot, nor is there any qualification barriers on the part of the players or dealer which would prevent the players from collecting the pot. High ranking poker hand wins.

DESCRIPTION OF THE PREFERRED EMBODIMENT

Figure 1:
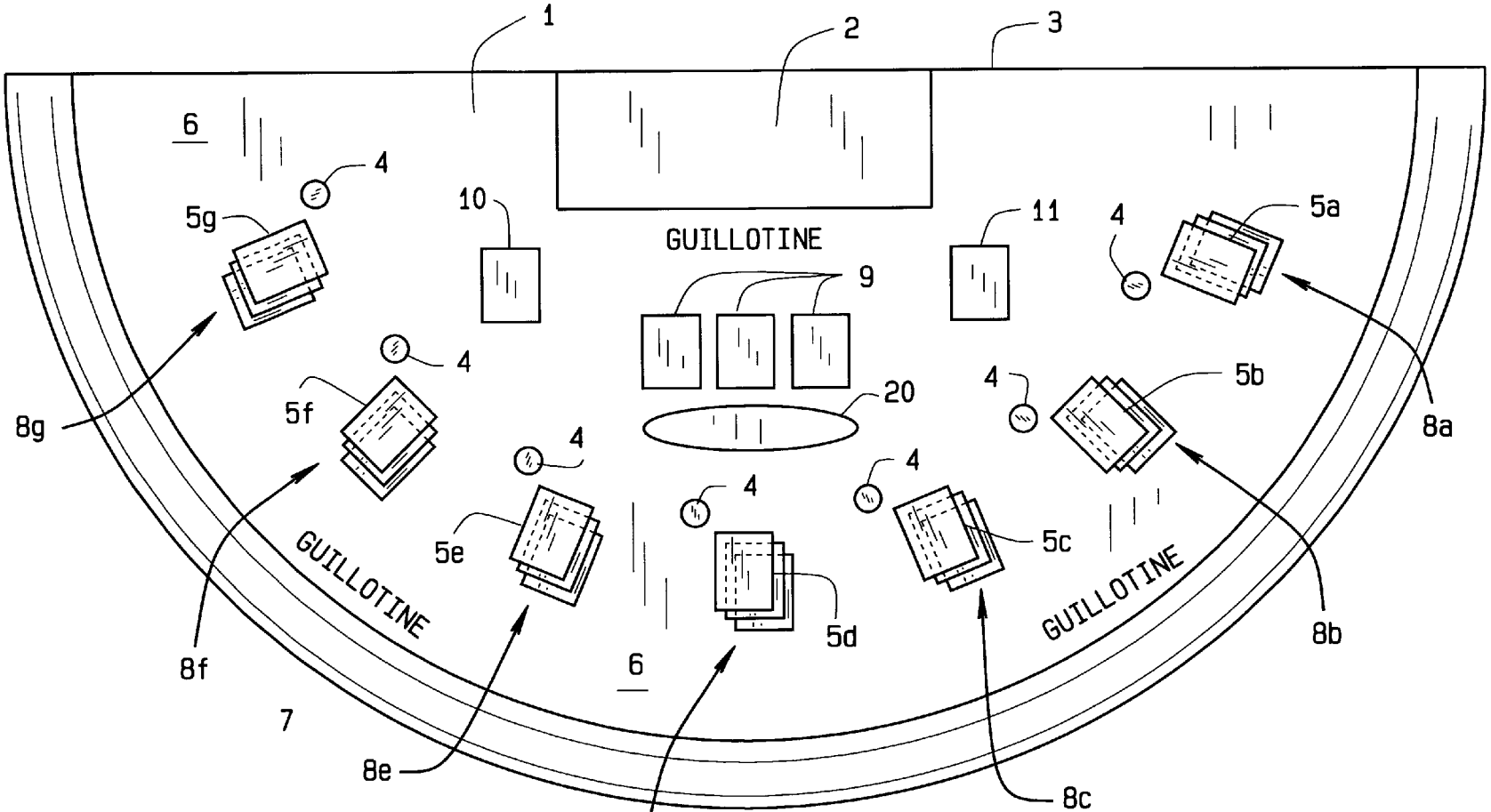
FIG. 1 depicts the table layout and apparatus used in playing the wagering game of the present invention.

In referring to FIG. 1, the apparatus for the wagering game of the present invention includes a typical casino gambling or gaming table 1. The table 1 has a curved side 7 for accommodating up to seven players and a straight side 3 for accommodating the dealer. The table 1 has a flat surface 6 covered with felt or other appropriate material. Although seven playing positions or locations 8 a–g for individual players are provided, it is not essential to the game that exactly seven persons play and as many as eleven players may participate. For casino play, a maximum of seven players provides for a gam that is easily manageable by he dealer and house, and one which the individual players feel more involved. A house dealer position 2, including an area suitable for displaying the dealer's cards 9, is provided. Each of the playing positions 8 a–g also includes a card area 5 a–g for receiving and displaying cards dealt to the player occupying the position. The wagering area 4 is designed to receive appropriate wagering indicators or settling means such as chips (not shown).

A wagering area suitable for placing chips (not shown) gathered for final pot shall be located in the center of the table directly in front of the community cards. In addition, two areas, one to the left, one to the right, will be used for placing dealer's hand and unplayed deck or "live" deck respectively. A display device may be associated with the apparatus for displaying game information.

Figure 2:
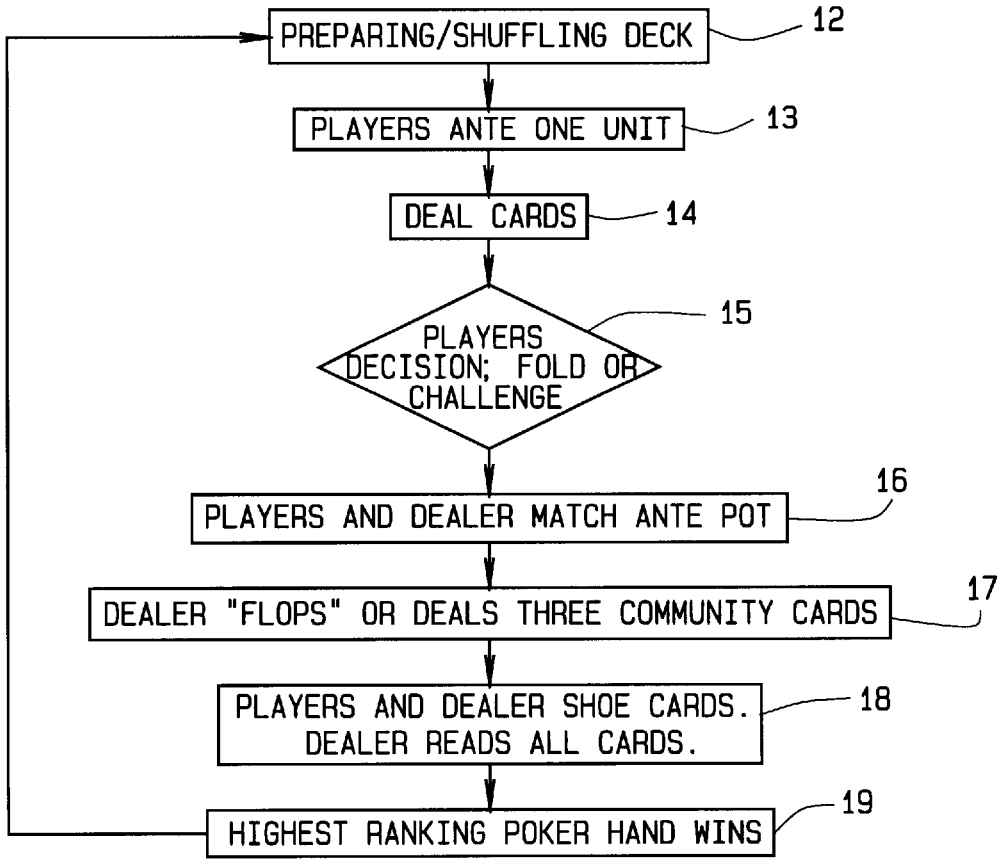
FIG. 2 is a block diagram representing the flow of play in the game.

Referring to the flow diagram of FIG. 2, the initial step in playing the game of the present invention is preparing or shuffling a deck of cards, represented at block 12, by activating a shuffling machine 12 or by hand shuffling a deck to provide s shaffled deck. Next, the players place the initial wager, block 13 by putting one unit in betting area block 13. After placing of the wager by each player, the cards are dealt, block 14. Four cards dealt down to each player and four cards being dealt down to the dealer. The players inspect or "sweat" their cards in preparation for reaching decision block 15. At decision block 15, the players are queried by the dealer about whether the player will fold or challenge the remaining players and dealer. Each player makes the decision at decision block 15 on the basis of the four cards forming the player's incomplete hand at this point. Once each player has been queried and has decided whether or not to fold or challenge, the dealer will gather the ante bets of the challenging players and announce the amount of the ante pot to be matched by each challenging player and the dealer. The dealer will have collected the ante bet and cards of each player who elected to fold. The dealer will place all chips comprising the final pot in wagering area block 20. The dealer will have collected all wagers comprising the final pot in addition to matching the ante pot himself. The dealer will then after "burning" or dealing a card from the top of the deck "flop" or deal three community cards to be used by each player to make the highest ranking poker hand, along with the four initial cards dealt to each player and dealer. The dealer will then read all hands in the game and the highest ranking poker hand wins the pot. The hand is then over and the flow of the game returns to block 12, preparing and shuffling the deck for a new hand.

The method of the present invention is not limited to seven card poker games, but may be applied or used other appropriate games such as five card stud, Texas Hold Em and Omaha. The method of the present invention does not require a shuffling machine, dealing module or a display means. However, these facilitate and expedite the play of the game as well as add interest to the game. The wagering game of the present invention might be played live in casinos with a dealer, or in casinos or homes in interactive electronic or video form with automatic coin or betting means receptacles and payout capability, wherein appropriate symbols for cards, wagers or score keeping would be displayed electronically. A "board-type game" suitable for home, club or casino use may also be provided for practicing the method of the present invention.

Single player versus the dealer has the option to double the "ante pot," resulting in the dealer doing likewise.

Figure 3:
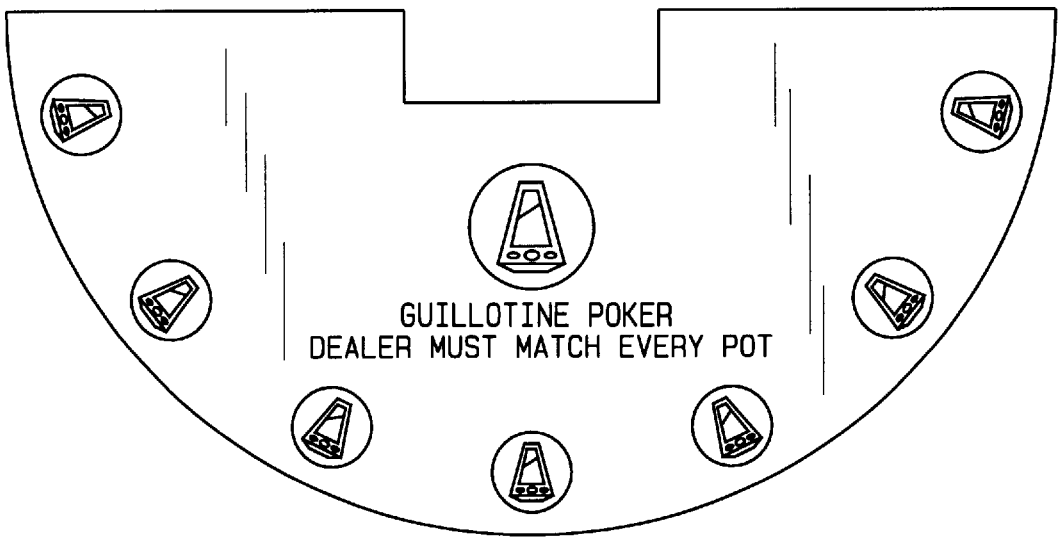
FIG. 3 depicts the actual table layout and apparatus used for playing the Guillotine Poker Game of this invention.

FIG. 3 shows the actual table layout for performance of the Guillotine Poker card and wagering game of this invention. As can be seen, the dealer must match every pot during performance of the game.

The present invention may be embodied in other specific forms without departing from the essential attributes thereof. It is desired that the embodiments described above may be considered in all respects as illustrative, not restrictive, reference being made to the appended claims to indicate the scope of the invention.

I claim:

1. A method of playing a wagering game with a single, typical fifty-two card poker deck, the cards having a standard rank in value, said game, when played, providing for the evaluation of cards in pairs and straights equivalent to a standard game of poker, comprising the steps of:

each player in the wagering game anteing one unit of betting to participate in the game;

the dealer deals the same number of a plurality of cards face down to each player in the game and to himself, the cards the dealer initially deals to each player face down is four;

each player evaluates his/her hand and elects to fold or challenge the remaining players and the dealer, the player who folds surrenders his/her previous ante, and the dealer then accumulates all antes into an ante pot;

any player who folds surrenders his/her initial ante to the dealer;

each player electing to challenge the dealer must contribute to match the entire ante pot to remain in the wagering game;

the dealer likewise contributes to match the ante pot;

the dealer thereafter deals a series of additional community cards face up which can be used by the remaining players, and the dealer, to determine a winner based upon the highest ranking poker hand in the game, the community cards the dealer deals during playing of the game is three;

thereafter the dealer reads all hands and declares who is the winner of the wagering game.

2. The method of claim 1 where the dealer burns a card from the top of the poker deck before dealing the three community cards.

3. The method of claim 1 and including a playing surface, provided upon a table located between the dealer and the players, said playing surface having a cards-receiving area for receiving and showing the cards dealt to each participating player and the dealer, a wager-receiving area for the ante pot, and a common card-receiving area for receiving and showing the community cards.

4. The method of claim 1 wherein the dealer must challenge each player in the game and may not fold during the course of playing this wagering game.

5. The method of claim 1 wherein the first player to challenge is determined on a rotating basis to eliminate position advantage.

6. The method of claim 5 wherein each participating player competes against each other as well as the dealer.

7. The method of claim 1 wherein the quantity of the second wager is an amount equal to the ante pot.

8. The method of claim 1 wherein the wager comprises a two-part wager.

9. The method of claim 1 wherein the sequence for evaluating the winner of the wagering game comprises the sequence to determine the winner in a standard poker game, the highest rank for winning comprising the royal flush, straight flush, four of a kind, full house, flush, straight, three of a kind, two pairs, one pair and the highest card, in said descending order.

10. A method of playing a wagering card game for a number of players using the standard playing cards, said game involving standard poker hand rankings, and comprising the steps of:

each player participating in the wagering game placing a wager to participate in the game;

a dealer dealing four cards down to each player, and four cards down to the dealer;

providing each player with the opportunity to examine his/her cards received by that player, and thereafter electing to fold or remove from the game, or challenge the competing players and the dealer;

each player challenging must wager an amount equal to the ante accumulated pot which is determined by the remaining players challenging, and wherein the dealer must match the ante pot;

the dealer must remain in the game and cannot fold;

any player who folds surrenders his/her ante to the house;

the dealer must challenge every hand regardless of the strength of the dealer's hand;

the first player to act is determined on a rotating basis to eliminate position advantage;

the dealer after burning the top card of the deck will deal or flop three community cards which the players and dealer will use to make the highest ranking poker hand possible, along with their four initial cards; and whereby the highest ranking poker hand wins the ante pot, as matched.

* * * * *